United States Patent [19]

Partain

[11] 4,293,069

[45] Oct. 6, 1981

[54] WARDROBE CONTAINER

[75] Inventor: James H. Partain, Norcross, Ga.

[73] Assignee: Stone Container Corporation, Chicago, Ill.

[21] Appl. No.: 125,155

[22] Filed: Feb. 27, 1980

[51] Int. Cl.[3] ..... B65D 85/18

[52] U.S. Cl. ..... 206/279; 206/280; 206/289; 206/299

[58] Field of Search ..... 206/279, 280, 284, 285, 206/289, 298, 299; 229/23 R, 37 R; 312/259

[56] References Cited

U.S. PATENT DOCUMENTS

| | | | |
|---|---|---|---|
| 3,294,221 | 12/1966 | Notko et al. | 206/289 |
| 3,369,652 | 2/1968 | Bebout | 206/299 |
| 4,111,300 | 9/1978 | Partain | 206/280 |

*Primary Examiner*—Joseph Man-Fu Moy

*Attorney, Agent, or Firm*—Silverman, Cass & Singer, Ltd.

[57] ABSTRACT

An improved hanger bar support means for the hanger bar of a wardrobe container formed from a paperboard blank. The container body is formed from a pair of side walls, a pair of end walls and a bottom wall joined together with the upper end of said body being open. Each end wall has a closure flap connected thereto and each side wall has a top end flap hingedly connected along the upper edge of the side wall and coextensive with the width of the side wall. Each top end flap includes first and second panels folded into a multiple ply hanger bar support assemblage engaging against the contiguous side wall below said upper edge of the side wall either on the exterior or the interior of the container body. Said first and second panels are hingedly connected together along a double fold line spaced from said upper edge. Said assemblage includes a third panel hingedly connected to the second panel having reinforcing flap means struck from and hingedly connected to a medial body portion of the panel for movement to a position sandwiched between the first and second panels and engaging the double fold line, the ends of the hanger bar being supported on said multiple panel assemblages between the side walls on the interior of the container body with said flap means reinforcing said assemblage by assisting in spreading the weight of the hanger bar along the double fold line.

4 Claims, 4 Drawing Figures

WARDROBE CONTAINER

BACKGROUND OF THE INVENTION

This invention relates generally to wardrobe containers formed of paperboard and more particularly, to improved support means for a conventional hanger bar to be supported from the upper ends of opposite walls of the container and spanned between said walls.

Wardrobe containers formed from integral paperboard blanks are well known as being economical, light in weight and durable. The upper end of the container body is designed to support a conventional hanger bar spanned between opposite walls of the container body so that articles of clothing on clothes hangers can be supported from the span of the hanger bar in the interior of the container body. Since the normally thin paperboard walls inherently lack certain strength features in the planes thereof for supporting a hanger bar, it has been known to form hanger bars support formations integral with the paperboard blank which rigidify the container walls intended to support the hanger bar. U.S. Pat. Nos. 4,111,300 and 4,151,947 disclose such wardrobe containers with means for supporting a hanger bar, these patents and this application having a common assignee.

The herein invention achieves its objectives by utilizing selectively cut and folded parts of a pair of top end flaps hingedly connected along the upper edges of a pair of side walls of the container body. Each top end has a hingedly connected support flap of generally trapezoidal shape arranged to spread the weight of the hanger bar supported on said opposite side walls of the container body and reinforce the assemblage of support panels for the hanger bar provided by said top end flaps. Advantageous economy in fabrication of the container is realized along with the improved hanger bar support means which supplies desired additional support strength for the hanger bar.

SUMMARY OF THE INVENTION

The wardrobe container is formed from an integral blank of paperboard to provide a container body open at the upper end thereof. The container body is provided by a pair of side walls, a pair of end walls having closure flaps at the upper ends thereof, and a bottom wall. Each side wall has a top end flap hingedly connected along the upper end of the side wall coextensive with the width thereof. Each top end flap is comprised of a first panel hingedly connected to the contiguous side wall, a second panel hingedly connected to the first panel along a double fold line spaced from said upper end of the side wall and a third panel connected along a fold line to the second panel. Each top end and flap has hanger bar support means struck from a medial body portion thereof when the first and second panels are folded into engagement with a contiguous side wall either on the exterior or interior of the container body. Said third panel has a medial reinforcement hinged flap member struck therefrom and sandwiched between said first and second panel and engaged with the double fold line. Said flap member is of selected configuration to provide an elongated end opposite its hinged connection with the third panel for reinforcing the hanger bar support means.

DESCRIPTION OF THE PREFERRED EMBODIMENT

Figure 1:
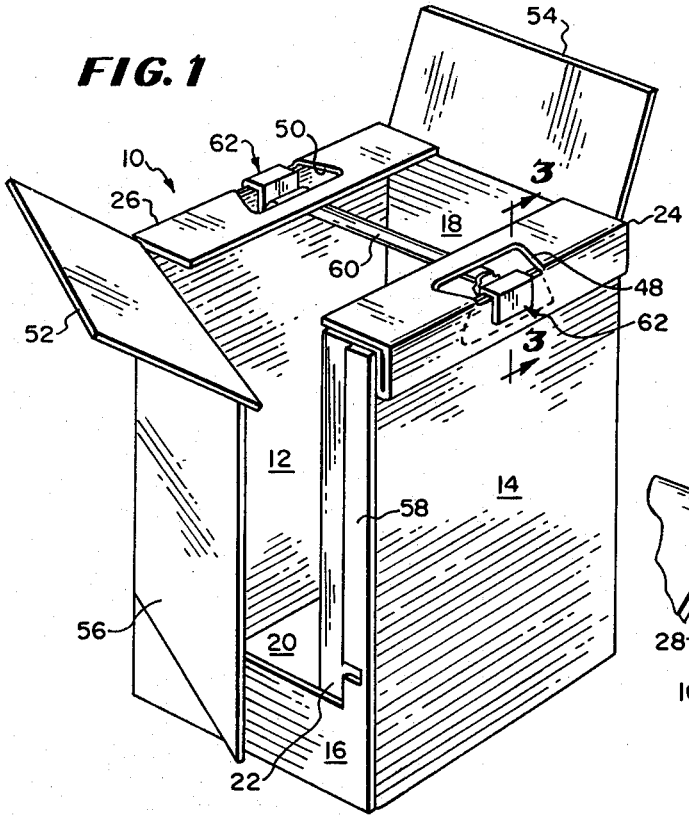
FIG. 1 is a perspective view of the wardrobe container shown partially assembled and illustrating the hanger bar support means embodying the invention.

Referring to FIG. 1, there is illustrated a wardrobe container designated generally by the reference character 10. The container 10 can be erected from integral blanks die-cut from sheeting of paperboard, either corrugated or otherwise, or from other like material by conventional automatic machinery. Wardrobe container 10 includes two side walls 12 and 14, two end walls 16 and 18 and a bottom wall 20 which are cojoined along lines of fold. The side wall 14 has an extension providing a hinged panel 22 which abuts a portion of end wall 16 and which may be assembled thereto with adhesive or other suitable fastening means.

Figure 2:
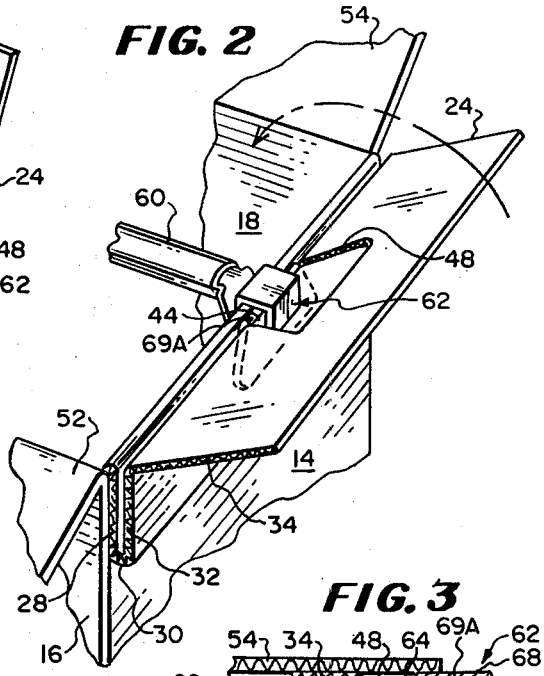
FIG. 2 is an enlarged fragmentary perspective view of the container body showing the support means of FIG. 1.
Figure 3:
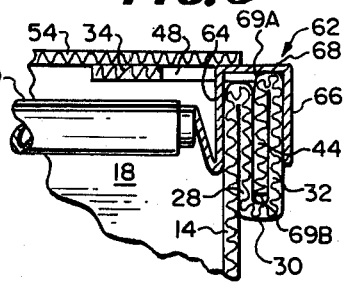
FIG. 3 is a fragmentary sectional view taken along the line 3—3 of FIG. 1 and in the direction indicated generally and showing the support bar means in folded assemblage on the exterior of the container body.

A first pair of end flaps 24 and 26 is hingedly connected to the upper edges of side walls 12 and 14, respectively. End flap 24 includes a first panel 28, connected to the top free edge of side wall 12, a double score line segment 30 connected to first panel 28, a second panel 32 connected to double score segment 30 and a third panel 34 connected to second panel 32. End flap 36 likewise has a first panel 36, a double score line segment 38, a second panel 40 and a third panel 42. Each of the third panels 34 and 42 includes a reinforcement support flap means 44 and 46, respectively, partially severable therefrom, as seen in FIG. 3, which are foldable separately from the third panels to a position sandwiched between the first and second panels, leaving cutouts 48 and 50, as seen in FIGS. 1, 2 and 3. Note that the folded assemblage of panels and support flap means are illustrated positioned exterior of the container body.

A second pair of top end flaps 52 and 54 is provided hingedly connected to end walls 16 and 18, respectively, and is adapted to be folded over the first pair of end flaps 24 and 26. The top end flap 52 is hingedly connected to the side wall 12 and terminates above the bottom portion of the end wall 16 and has a width less than the end wall 16 to leave a narrow end to all portion 58. A full description of the access panel and its operation is found in U.S. Pat. Nos. 4,111,300 and 4,151,947.

A hanger bar 60 of conventional design is fitted over the folded assemblage of panels 28 and 32 and the hanger bar support flap means 44 and 46, as illustrated in FIGS. 1, 2 and 3. The hanger bar 60 includes U-shaped end portions 62 each of which include spaced, parallel legs 64 and 66 connected by section 68, as shown in FIG. 3. End portion 62 is secured through cutouts 48 and 50 over the multiple panel folded assemblage illustrated in FIG. 3. Preferably, the multiple panel folded assemblage will comprise four plies of material to supply sufficient support for the weight of the hanger bar and the supported articles, such as garments which are suspended from the bar 60 in the container 10.

Support flap means 44 comprises a trapezoidal-shaped support flap having the shorter one 69A its two parallel sides hingedly connected to the second panel and extending between the folded first and second panels with its longer free end 69B closely adjacent to the double score line segment 30. Top portion 68 of hanger bar end portion 60 engages on the panels 28 and 32 and rests on this shorter end 69A of the support flap so as to force the support flap downwardly. The longer parallel side 69B engages against the double score line segment 30. The weight carried by hanger bar 60 is thus spread by the support flap along the double score line segment 30 with the segment 30 acting as a reinforcement against tearing and crushing of the support flap. While the weight of the hanger bar 60 is concentrated over a short distance on the short parallel side 69A of the support flap, this weight is distributed over the longer length of the segment 30 by the longer parallel side 69B of the support flap.

Figure 4:
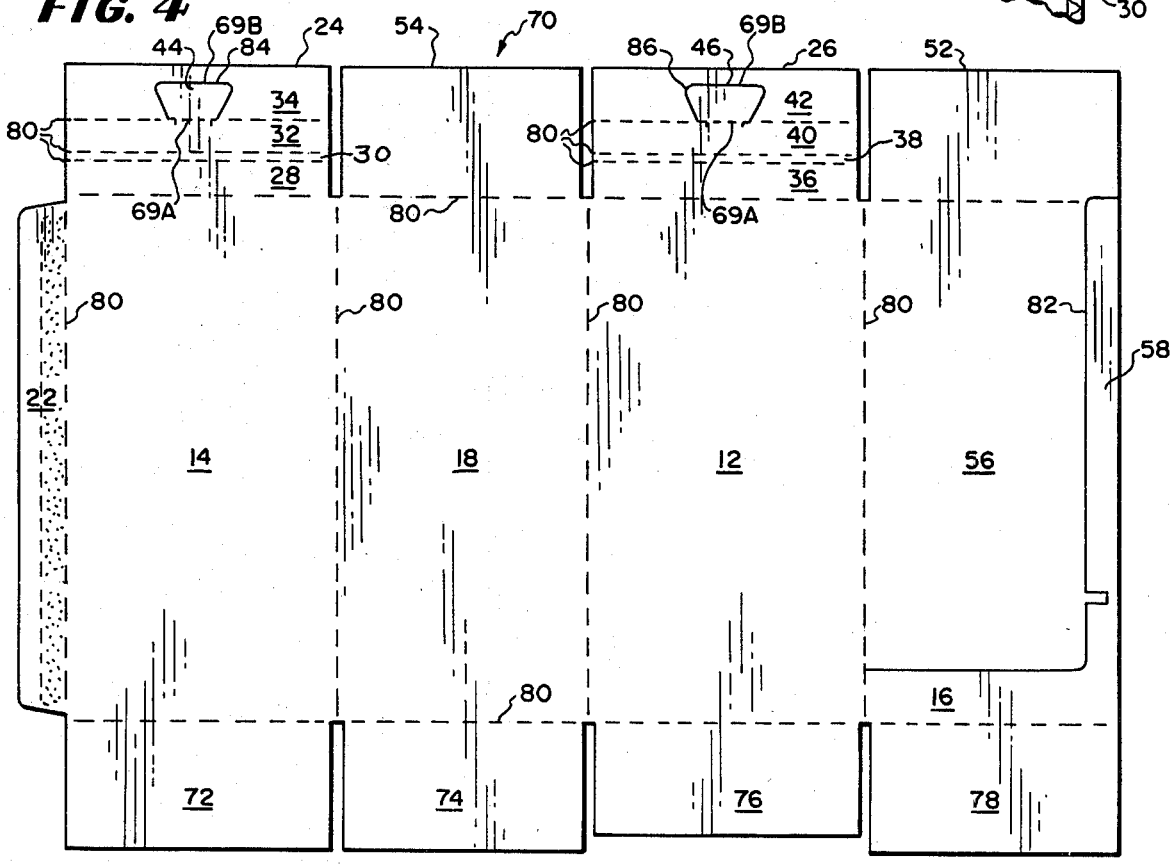
FIG. 4 is a plan view of a carton blank from which the wardrobe container of FIG. 1 can be erected.

The wardrobe container 10 preferably is formed from a one piece blank 70 which is illustrated in FIG. 4. The bottom wall 20 of the container 10 is formed from four bottom flaps 72, 74, 76 and 78 in a conventional manner. Bottom flaps, top flaps, the side walls and end walls, as well as the side flap 20, 22 are connected along the lines of fold 58. The first panels, double score line segments, second panels and third panels are likewise connected along the lines of fold 80. The access panel 56 is formed from the end wall 16 along a cut or perforation line 82. The support flap means 44 and 46 are formed from the respective end flaps 24 and 26 along respective cut or perforated lines 84 and 86. The lines 82, 84 and 86 preferably are not completely cut when the blank is manufactured so that the access panel 56 and the flap means 44 and 46 will stay in place until the container 10 is to be assembled.

It is intended that the invention contemplates implementation thereof in connection with other than the top flaps of the side walls 12 and 14. The first panels, double score line segment, second panels, third panels and support flap means may be provided on the top flaps 52 and 54 of the end walls 16 and 18 and the access panel 56 being provided on the other end wall or on one of the side walls 12 and 14. The four ply hanger bar support assemblage also may be disposed alternatively on the interior of the container 10. The respective sizes illustrated also are exemplary only and many other combination of sizes of the walls and flaps and panels in the correspondingly assembled carton are possible within the scope of the invention. For instance, other than a trapezoidal shape for the auxiliary support flap means 44 or 46 would be feasible so long as the free end of the flap is elongated for spreading the weight of the hanger bar end along the double fold line segment.

What is desired to be secured by Letters Patent of the United States is:

1. In a wardrobe container formed from a one piece blank having at least two side walls, two end walls and a bottom wall connected together and including a hanger bar having opposed end portions each defined by inside and outside legs and a connecting top portion, the improvement comprising;

a pair of top flaps each hingedly connected along a top free edge of one of said two side walls and having a uniform thickness, each of said flaps including first and second panels connected together along a double score line segment spaced from a said free edge with said first panel connected to said side wall, said first and second panels being folded in planes parallel to said side wall adjacent said top free edge thereof and being spaced apart by said segment, each of said top flaps including a third panel connected to said second panel and foldable across the top of the container, said third panel including hinged support flap means foldable to a position sandwiched between said first and second panels to form a four ply assemblage adjacent said top free edge, said flap means defining an opening in said third panel through which said hanger bar end portions are inserted with said inner and outer legs containing at least a part of said four ply assemblage therebetween and said top portion engaged adjacent said top free edge and on said support flap means, said support flap means reaching to adjacent said double score line segment so that the weight of said hanger bar carried by said end portions is transmitted in part by said support flap means to said segment.

2. The improvement as claimed in claim 1 in which each of said support flap means comprises a flap member cut from said third panel having a width less than the width of the top flap.

3. The improvement as claimed in claim 2 in which the length of the hinged connection of the support flap is substantially less than the length of the free end thereof.

4. The improvement as claimed in claim 2 or 3 in which the support flap member is substantially trapezoidal in configuration, the hinged connection of the said support flap being shorter than the opposite free end thereof.

* * * * *